US010709233B2

(12) United States Patent
Goldmann

(10) Patent No.: US 10,709,233 B2
(45) Date of Patent: Jul. 14, 2020

(54) METHOD AND DEVICE FOR THE MANUFACTURE OF SCRUBBING BRUSHES AND/OR PAINTING BRUSHES

(71) Applicant: Zahoransky AG, Todtnau (DE)

(72) Inventor: Philipp Goldmann, Wembach (DE)

(73) Assignee: Zahoransky AG, Todtnau (DE)

( * ) Notice: Subject to any disclaimer, the term of this patent is extended or adjusted under 35 U.S.C. 154(b) by 121 days.

(21) Appl. No.: 16/127,721

(22) Filed: Sep. 11, 2018

(65) Prior Publication Data

US 2019/0098991 A1 Apr. 4, 2019

(30) Foreign Application Priority Data

Oct. 4, 2017 (DE) ..... 10 2017 123 007

(51) Int. Cl.
*A46D 3/06* (2006.01)
*A46D 99/00* (2006.01)
*A46D 3/04* (2006.01)

(52) U.S. Cl.
CPC ..... *A46D 3/065* (2013.01); *A46D 3/04* (2013.01); *A46D 99/00* (2013.01)

(58) Field of Classification Search
CPC ... A46D 3/02; A46D 3/04; A46D 3/06; A46D 3/065; A46D 3/067; A46D 99/00
See application file for complete search history.

(56) References Cited

U.S. PATENT DOCUMENTS 3,093,416 A * 6/1963 Schmidt ..... A46D 3/065 300/21
4,310,377 A * 1/1982 Lorenz ..... A46D 3/045 156/499
5,588,714 A * 12/1996 Boucherie ..... A46D 3/06 300/21
7,699,403 B2 * 4/2010 McCarthy ..... A46D 9/02 300/11
2005/0168050 A1 * 8/2005 Boucherie ..... A46D 3/067 300/2
2016/0015162 A1 * 1/2016 Kumpf ..... A46D 3/08 300/12
2019/0133311 A1 * 5/2019 Boucherie ..... A46B 3/04
2019/0150605 A1 * 5/2019 Hu ..... A46D 3/085

* cited by examiner

*Primary Examiner* — Dung Van Nguyen
(74) *Attorney, Agent, or Firm* — Volpe and Koenig, P.C.

(57) ABSTRACT

A method for the manufacture of scrubbing brushes and/or painting brushes is provided, in which a processing pressure exerted by a processing tool (3, 4) onto a bristle holder (5) to be processed is determined by a pressure sensor (6), which has a pressure-recording surface (7), which is arranged behind the bristle holder (5) to be processed, in the operating direction of the processing tool (3, 4). In this manner, determination of the processing pressure is possible close to the bristle holder (5) to be processed.

17 Claims, 1 Drawing Sheet

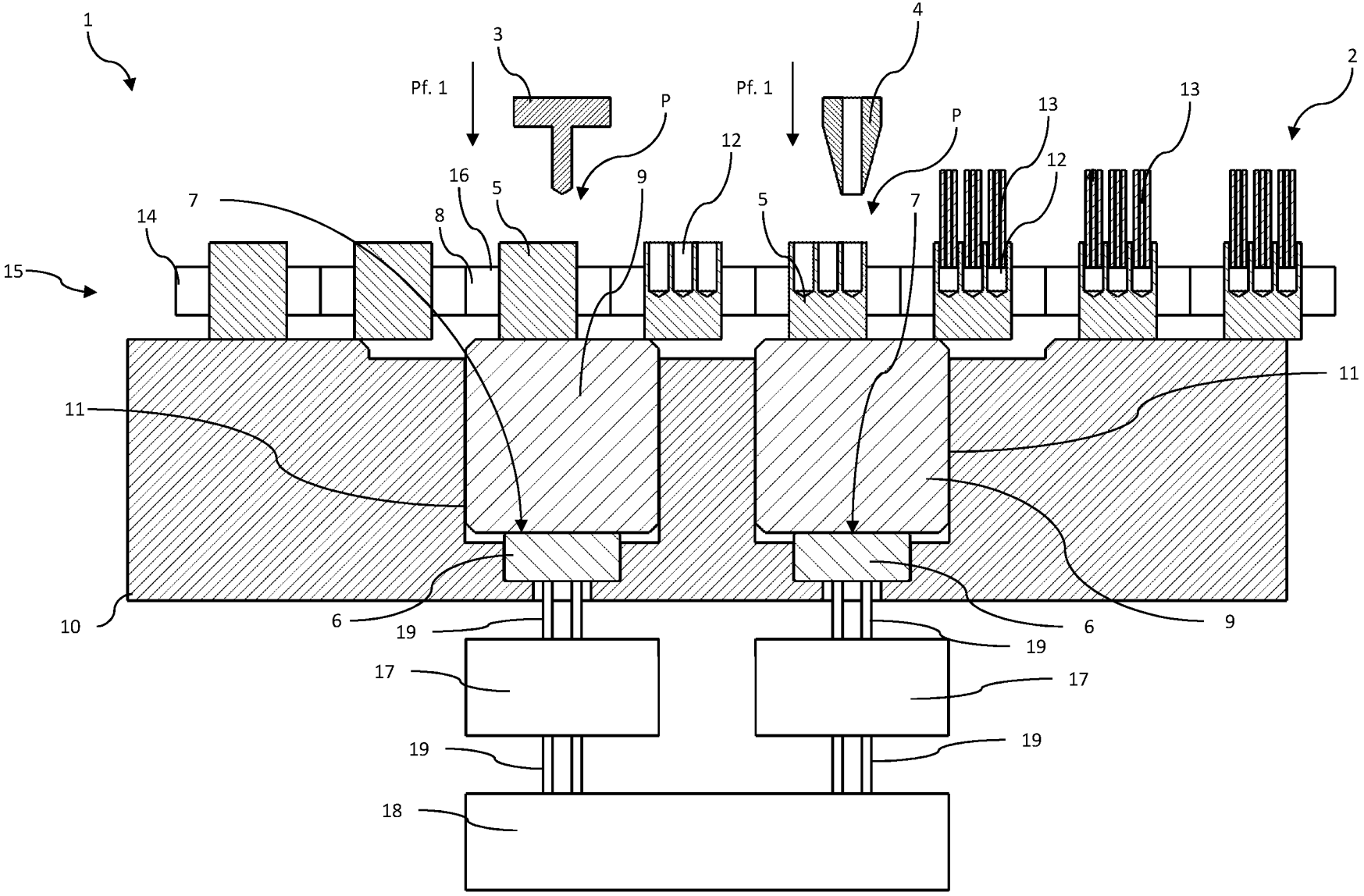
2
13
13
12
P
4
Pf. 1
12
P
3
Pf. 1
1
15
14
7
16
8
5
5
7
9
11
11
9
6
6
19
19
19
19
17
17
18
10

METHOD AND DEVICE FOR THE MANUFACTURE OF SCRUBBING BRUSHES AND/OR PAINTING BRUSHES

INCORPORATION BY REFERENCE

The following documents are incorporated herein by reference as if fully set forth: German Patent Application No. 10 2017 123 007.6, filed Oct. 4, 2017.

BACKGROUND

The invention relates to a method and a device for the manufacture of scrubbing brushes and/or painting brushes, wherein the device has at least one processing tool for processing a bristle holder of a scrubbing brush to be manufactured and/or a painting brush to be manufactured.

Such methods and devices are known from practice in various embodiments. It is desirable to achieve uniform results in the processing of the bristle holders. For this purpose, it is known, for example, to monitor a parameter, usually a processing force of a processing tool, with which force the bristle holder is processed. When inserting bundles of bristles into the bristle holder, this parameter can be the insertion force or the insertion pressure. When generating bundle-accommodating holes in bristle holders by a drill, the parameter to be monitored can be the force or the pressure with which the drill is fed in the direction of the bristle holder during the drilling process.

In the devices known from the prior art and from practice for the manufacture of scrubbing brushes and/or painting brushes, it is, for example, known to provide an appropriate sensor on a main shaft with which a processing tool, such as an insertion tool or else a drill of the device, is driven. The sensor can monitor a force applied to the main shaft of the device. Thus, at least indirectly, a processing force of the processing tool can be deduced.

Similar sensor arrangements are also to be found, for example, in the case of drilling tools with which bundle-accommodating holes are generated in bristle holders.

A sharp rise or fall in the forces determined can then indicate a malfunction of the device. During an insertion operation, it can happen, for example, that a so-called pawl tongue of the insertion tool breaks during the insertion of the bundles of bristles. Similarly, a sharp rise or fall of the monitored parameter during a drilling operation can indicate, for example, a breakage of the drill.

The sensor arrangements known hitherto allow only a comparatively indirect determination of the processing forces occurring and are also relatively expensive in terms of build.

SUMMARY

The object of the invention is therefore to provide a device and a method of the type cited in the introduction, which allow easier monitoring of the processing of a bristle holder.

To achieve this object, the method having one or more features of the invention directed towards a method for the manufacture of scrubbing brushes and/or painting brushes is provided, in which a bristle holder of a scrubbing brush and/or a painting brush to be manufactured is processed with a processing tool of a device for the manufacture of scrubbing brushes and/or painting brushes in a processing position, which is arranged between a pressure-recording surface of a pressure sensor and a processing tool of the device, and wherein a processing pressure, which is exerted by the processing tool onto the bristle holder during the processing of the bristle holder, is transferred to the pressure-recording surface and determined by the pressure sensor.

Here it can be expedient if the pressure-recording surface is arranged behind the bristle holder, in the operating direction of the processing tool. In this manner, the bristle holder is arranged between the processing tool and the pressure-recording surface in the force flow direction. Thus the processing pressure can be efficiently transferred from the processing tool, by way of the bristle holder, to the pressure-recording surface and the pressure sensor.

In this manner, monitoring of the processing pressure can take place without a force or pressure sensor that is arranged on a main shaft of the device for the manufacture of scrubbing brushes and/or painting brushes. Furthermore, the monitoring of the processing pressure, which correlates with the processing force exerted on the bristle holder by the processing tool, can take place closer to the bristle holder to be processed. This has the effect that a more accurate monitoring of the processing pressure is possible, and, in particular, one that is also simpler in terms of build. Here the pressure-recording surface and the pressure sensor can be arranged in a stationary manner on a frame of the device. This has the advantage that dynamically moving parts and cables can be dispensed with; these are always subject to a certain amount of wear and a certain risk of damage.

It can be particularly expedient if a deviation between the processing pressure determined with the at least one pressure sensor and a target pressure is determined by a comparator, and if the processing is halted by a controller of the device if the deviation reaches or has a defined magnitude. In this manner, further processing of the bristle holder can be prevented in the event of a feared malfunction of the device, which can be indicated by a deviation between the processing pressure determined and a stored target pressure, and thus greater damage to the bristle holder or else to the device can be avoided.

To achieve the object, a device for the manufacture of scrubbing brushes and/or painting brushes with one or more features of the invention directed towards such a device is also provided. In particular, to achieve the object with the device defined in the introduction, it is provided that the device comprises at least one pressure sensor with a pressure-recording surface, and a processing position for the bristle holder, which processing position is associated with the at least one processing tool and is arranged between the processing tool and the pressure-recording surface of the pressure sensor such that a processing pressure exerted on the bristle holder by the processing tool can be transferred onto the pressure-recording surface and determined with the pressure sensor.

In addition, the device can be set up for executing the method explained above. One advantage of the device is that monitoring of the processing operation is simpler in terms of build compared to a sensor arrangement that acts on a main shaft of the device. Furthermore, in the inventive device a smaller number of moving parts and/or cables, which could be damaged, especially in the event of highly dynamic processing of the bristle holder is needed. In comparison to the determination of the processing pressure and/or the processing force by way of a sensor acting on the main shaft of the device, the determination of the processing pressure in the inventive device takes place closer to, and thus in more direct proximity to the bristle holder and the engagement of the processing tool.

The processing pressure, which can ultimately be determined with the pressure sensor, is related to the processing force that the processing tool exerts on the bristle holder during processing. From the processing pressure the processing force, and ultimately also any malfunction of the device, can be deduced.

If the pressure-recording surface is arranged behind the processing position for the bristle holder in the operating direction of the processing tool, the processing pressure exerted by the processing tool can be transferred to the pressure-recording surface without any deflection by way of the bristle holder located in the processing position. Thus, the processing pressure can be determined with the pressure sensor comparatively easily and with sufficient accuracy. In this context it can be particularly advantageous if the pressure-recording surface is oriented at right angles to the operating direction of the processing tool.

Depending on the type of processing tool, the operating direction can also be a feed direction or a delivery direction of the processing tool.

The device can have at least one support for a bristle holder to be processed. This at least one support can be arranged in a processing position assigned to the at least one processing tool, between the processing tool and the pressure-recording surface.

Furthermore, it is possible for the device to have a pressure-transfer element. The said pressure-transfer element can be arranged between the support and the pressure-recording surface, and/or between the bristle holder and the pressure-recording surface of the at least one pressure sensor, when the support is in the processing position, and/or when the bristle holder is in the processing position. The pressure-transfer element is designed such that, for example, a processing pressure exerted onto the bristle holder is transferred uniformly onto the pressure-recording surface of the pressure sensor. This can facilitate a more accurate determination of the processing pressure. In a preferred embodiment of the device, the pressure-transfer element can be arranged and designed such that a bristle holder located in the processing position makes direct contact with the pressure-transfer element, that is to say bears against the latter. The pressure-transfer element can serve as an abutment for the at least one processing tool and the bristle holder to be processed, against which abutment the bristle holder is supported while it is being processed.

The at least one pressure sensor and the pressure-recording surface of the at least one pressure sensor can be arranged on a frame of the device. Thus, the at least one pressure sensor and its pressure-recording surface can be arranged in a stationary and/or essentially immovable manner on the frame of the device. Supply and/or signal lines leading to and from the pressure sensor are then essentially not moved during operation of the device. Thus, movement-related signs of wear on supply and signal lines of the pressure sensor and its pressure-recording surface can be largely avoided, and thereby the availability of the device can be improved.

The device can also have a seating, in which is arranged the pressure-transfer element, preferably in a manner guided and/or moveable in the operating direction of the at least one processing tool. In this manner, the pressure-transfer element can on the one hand be protected in its position of use on the device, and on the other hand can be captively arranged in said position.

As at least one processing tool, the device can have, for example, a drill for the manufacture of bundle-accommodating holes in a bristle holder. However, it is also possible for the device to have as at least one processing tool, or else as another processing tool, an insertion tool for the filling of the bundle-accommodating holes of a bristle holder with bundles of bristles. A processing position on the device can then be assigned to each processing tool. A pressure-recording surface and a pressure sensor are then preferably assigned to each processing tool in the region of these processing positions on the device. This is with the aim of being able to monitor the processing forces and/or pressures acting on the bristle holder located in each case in the processing position during processing by the respective processing tool.

Here, too, provision can be made for the at least one pressure-recording surface of the respective pressure sensor to be arranged behind the support arranged in the processing position, and/or behind the bristle holder arranged on the support, in the operating direction of the respective processing tool. In this manner, therefore, the processing force and the processing pressure of the processing tool can be transferred by way of the bristle holder to be processed onto the support on which the bristle holder is arranged, and finally can be transmitted from the support at least indirectly onto the pressure-recording surface of the pressure sensor. If the bristle holder bears directly on a pressure-transfer element or on the pressure-recording surface, the pressure transfer accordingly can take place directly from the bristle holder onto the pressure-transfer element or onto the pressure-recording surface. Here the determination of the processing pressure takes place much closer to the actual processing than is provided for in the methods and devices known hitherto for determining the processing pressure, which derive the processing pressure by way of a sensor that acts on a main shaft of the device.

The device can comprise a transport device. The said transport device can preferably be designed as a transport chain that has a plurality of supports for individual bristle holders arranged one behind another and connected to one another preferably in an articulated manner. Thus, a plurality of supports can be arranged on the transport device. With the transport device the supports can be transported from a processing tool to a subsequent processing tool, or a subsequent processing station of the device. Here a transport track, along which the supports can be transported with the transport device, can extend between the at least one processing tool and the pressure-recording surface of the at least one pressure sensor, which pressure-recording surface is assigned to the processing tool. In this manner, the supports, with the aid of the transport device, can be transported into their corresponding processing position on the one processing tool or successively into various processing positions of a plurality of processing tools. Once the supports have reached the processing position on the respective processing tool, they are automatically arranged such that a transfer of the processing force acting on a bristle holder onto the pressure-recording surface of the at least one pressure sensor is possible.

In order to fix the bristle holders reliably onto the at least one support, the latter can have a clamping device for a bristle holder.

It can be particularly advantageous if the device comprises a comparator and a controller connected to the comparator in terms of signals. The comparator can be set up to compare a processing pressure or actual pressure determined with the at least one pressure sensor with a stored target pressure, for determining a deviation between the processing pressure and the target pressure, and outputting a signal to the controller. Here the output of the signal to the controller takes place as a function of the deviation determined by the comparator between the actual pressure determined by the pressure sensor and the stored target pressure. The controller can be set up so as to shut down the device as a function of the determined deviation, in order to prevent any damage to the device or the bristle holder, or the manufacture of faulty parts.

It should be mentioned at this point that the manufacture of different painting brushes, in particular so-called nail varnish brushes, is possible with the above-described device and the above-described method. In this case, only a single bundle of bristles or cluster of filaments per painting brush is inserted into the front face of a shank-form bristle holder. In addition, the above-described method and the above-described device allow the manufacture and processing of individual scrubbing brushes and so-called strip brushes. Strip brushes are brushes in which the brush body forms a continuous brush strip. After their manufacture such strip brushes are shortened to a desired length.

BRIEF DESCRIPTION OF THE DRAWINGS

With the aid of the FIGURE, an embodiment of the invention is described in more detail below. In a highly schematic representation:

The FIGURE is a partially sectioned side view of a device for the manufacture of scrubbing brushes and/or painting brushes, having a first processing tool, designed as a drill, and a second processing tool, designed as an insertion tool for the insertion of bundles of bristles into bristle holders held in readiness, and having two pressure sensors assigned to the two processing tools for determining a processing pressure which is exerted by the respective processing tool onto the support and bristle holder arranged in the processing position.

DETAILED DESCRIPTION

The single FIGURE shows a device designated as a whole by 1 for the manufacture of scrubbing brushes 2 and/or painting brushes. The device 1 shown in the FIGURE has a total of two processing tools 3 and 4, of which a first is designed as a drill 3 and a second as an insertion tool 4. Both processing tools 3, 4 are set up for processing a bristle holder 5 of a scrubbing brush 2 to be manufactured. A pressure sensor 6 is assigned to each processing tool 3, 4 of the device 1. Each pressure sensor 6 has a pressure-recording surface 7 and is set up so as to determine a processing pressure which is exerted onto the bristle holders 5 by the respective processing tool 3, 4 of the device 1.

The pressure-recording surfaces 7 of the pressure sensors 6 are arranged behind the bristle holder 5 located in the processing position P, in the operating direction Pf.1 of the respective processing tool 3, 4. The processing positions P are respectively arranged between their processing tools 3, 4 and the pressure-recording surfaces 7 of the pressure sensors 6, which pressure-recording surfaces are assigned to said processing tools. Thus, during processing with the processing tools 3, 4, the bristle holders 5 are located between the processing tools 3, 4 and the pressure-recording surfaces 7 of the pressure sensors 6 assigned to the processing tools 3, 4.

The device 1 has a plurality of supports 8, which are each set up so as to accommodate a bristle holder 5. Here the supports 8 are arranged in the processing positions P assigned to the respective processing tools 3, 4, between the processing tools 3, 4 and the pressure-recording surfaces 7.

The device 1 also has a total of two pressure-transfer elements 9. With support 8 located in the processing position P and with bristle holder 5 located in the processing position P, the said pressure-transfer elements 9 are arranged between the respective support 8 and the respective pressure-recording surface 7, and also between the respective bristle holder 5 and the respective pressure-recording surface 7 of the pressure sensors 6.

The pressure sensors 6 and the pressure-recording surfaces 7 of the pressure sensors 6 are arranged on a frame 10 of the device 1. The pressure-transfer elements 9 are in each case arranged in a seating 11 on the frame 10 of the device 1. Within the seatings 11, the pressure-transfer elements 9 can be arranged such that they are guided and moveable in the operating direction Pf.1 of the respective processing tool 3, 4. As already stated above, the device 1 has a drill 3 as a first processing tool. The drill 3 is used to produce bundle-accommodating holes 12 in the bristle holders 5. The operating direction Pf.1 of the drill 3 is prescribed by its feed movement. As a second processing tool, the device 1 is equipped with an insertion tool 4 for filling the previously generated bundle-accommodating holes 12 in the bristle holders 5 with bundles of bristles 13. The operating direction Pf.1 of the insertion tool 4 is prescribed by its insertion movement.

The pressure-recording surfaces 7 of the pressure sensors 6 are arranged behind the supports 8 arranged in each case in the processing position P, and also behind the bristle holders 5 arranged thereon, in the operating direction Pf.1 of the two processing tools 3, 4.

The device 1 has a transport device 14, which in the present case is designed as a transport chain 14. A multiplicity of individual supports 8 is arranged on the transport chain 14. With the aid of the transport device 14, the supports 8 can be transported from one processing tool 3, 4 to a subsequent processing tool 3, 4, or else to a subsequent processing station, or else to a subsequent output station of the device 1. Here a transport track 15, along which the supports 8 can be transported by the transport device 14, extends between the processing tools 3, 4 arranged on the one side, and the pressure-recording surfaces 7 of the pressure sensors 6, which pressure-recording surfaces are assigned to the respective processing tools 3, 4 and are arranged on an opposite side of the device 1.

The supports 8 are also equipped with clamping devices 16 for bristle holders 5, so that the bristle holders 5 can be reliably fixed to the support 8 while they are being processed.

The device 1 additionally comprises a controller 18 and, for each pressure sensor 6, in each case a comparator 17. The controller 18 is connected to the two comparators 17 by way of appropriate signal lines 19. For signal transmission between the controller 18 and the comparators 17, wireless connections can be used in addition to, or instead of, signal lines 19. Each comparator 17 is set up so as to compare the processing pressures or actual pressures determined with the pressure sensors 6 with stored target pressures, and also so as to output signals to the controller 18, which represent a deviation determined between the actual and target pressures. The signals of the comparators 17 cause the controller 18 to shut down the device 1 if the deviations determined reach or exceed a certain value.

With the above-described device 1, the method described below for the manufacture of scrubbing brushes 2 and/or painting brushes can be executed. Here a bristle holder 5 of a scrubbing brush 2 to be manufactured and/or a painting brush to be manufactured is processed with a processing tool 3, 4 of the device 1. A processing pressure exerted by the processing tool 3, 4 onto the bristle holder 5 during the processing of the bristle holder 5 is transferred to the pressure-recording surface 7 and determined by the pressure sensor 6. The pressure-recording surface 7 of the pressure sensor 6 is arranged behind the bristle holder 5 in the operating direction Pf.1 of the processing tool 3, 4. Here the bristle holder 5 is located directly on the pressure-transfer element 9. Thus the processing pressure is first transferred to the bristle holder 5 and finally from the latter, by way of the pressure-transfer element 9, very uniformly onto the pressure-recording surface 7 of the pressure sensor 6. Here the determination of the processing pressure takes place for each of the two processing tools 3 and 4 independently, by way of separate pressure sensors 6.

The processing pressure determined with the aid of the respective pressure sensor 6 can then be compared by the respective comparator 17 with a stored target pressure, and processing can be halted automatically by the controller 18 in the event of a defined deviation between actual pressure and target pressure.

The invention is concerned with improvements in the field of the manufacture of scrubbing brushes and/or painting brushes. For this purpose, inter alia, the method for the manufacture of scrubbing brushes 2 and/or painting brushes is proposed, in which a processing pressure exerted by a processing tool 3, 4 onto a bristle holder 5 to be processed is determined by a pressure sensor 6, which has a pressure-recording surface 7, which is arranged behind the bristle holder 5 to be processed, in the operating direction Pf.1 of the processing tool 3, 4. In this manner, determination of the processing pressure is possible close to the bristle holder 5 to be processed.

LIST OF REFERENCE SYMBOLS

1 Device
2 Scrubbing brush
3 Drill
4 Insertion tool
5 Bristle holder
6 Pressure sensor
7 Pressure-recording surface
8 Support
9 Pressure-transfer element
10 Frame of 1
11 Seating for 9
12 Bundle-accommodating holes in 5
13 Bundle of bristles
14 Transport device
15 Transport track
16 Clamping device on 8
17 Comparator
18 Controller
19 Signal line between 6 and 17 and also between 17 and 18
P Operating Position

The invention claimed is:

1. A method for manufacturing at least one of scrubbing brushes (2) or painting brushes, the method comprising:

processing a bristle holder (5) of at least one of a scrubbing brush (2) or a painting brush to be manufactured with a processing tool (3, 4) of a device (1) for manufacturing at least one of scrubbing brushes or painting brushes in a processing position (P), said processing tool being arranged between a pressure-recording surface (7) of a pressure sensor (6) and a processing tool (3, 4) of the device (1), and determining a processing pressure exerted by the processing tool (3, 4) onto the bristle holder (5) during the processing of the bristle holder (5) that is transferred onto the pressure-recording surface (7) by the pressure sensor (6).

2. The method as claimed in claim 1, wherein the pressure-recording surface (7) is arranged behind the bristle holder (5) in an operating direction (Pf.1) of the processing tool (3, 4).

3. The method as claimed in claim 1, further comprising determining a deviation between the processing pressure determined by the at least one pressure sensor (6) and a target pressure using a comparator (17), and automatically halting processing using a controller (18) if the deviation reaches a defined magnitude.

4. A device (1) for manufacturing at least one of of scrubbing brushes (2) or painting brushes, the device comprising:

at least one processing tool (3) configured to process a bristle holder (5) of at least one of a scrubbing brush (2) or a painting brush to be manufactured;

at least one pressure sensor (6) with a pressure-recording surface (7); and a processing position (P) for the bristle holder (5), said processing position is associated with the at least one processing tool (3, 4) and is arranged between the processing tool (3, 4) and the pressure-recording surface (7) of the at least one pressure sensor (6) such that a processing pressure exerted onto the bristle holder (5) by the processing tool (3, 4) is transferred onto the pressure-recording surface (7) and the pressure sensor (6) is configured to determine the processing pressure.

5. The device (1) as claimed in claim 4, wherein the pressure-recording surface (7) of the at least one pressure sensor (6) is arranged behind the processing position (P) for the bristle holder (5), in an operating direction (Pf.1) of the processing tool (3, 4).

6. The device as claimed in claim 4, further comprising at least one support (8) for the bristle holder (5) to be processed, the at least one support (8) is arranged in the processing position (P) associated with the at least one processing tool (3, 4), between the processing tool (3, 4) and the pressure-recording surface (7).

7. The device (1) as claimed in claim 6, further comprising a pressure-transfer element (9), which, when at least one of the support (8) or the bristle holder (5) is in the processing position (P), is arranged between the support (8) and the pressure-recording surface (7), or between the bristle holder (5) and the pressure-recording surface (7).

8. The device (1) as claimed in claim 4, further comprising a transport device (14) on which a plurality of supports (8) are arranged, and with which the supports (8) can be transported from one processing tool (3, 4) to a subsequent processing tool (3, 4), and a transport track (15), along which the supports (8) are transported with the transport device (14), extends between the at least one processing tool (3, 4) and the pressure-recording surface (7) of the at least one pressure sensor (6), and said pressure-recording surface is assigned to the processing tool (3, 4).

9. The device (1) as claimed in claim 4, wherein the at least one pressure sensor (6) is arranged on a frame (10) of the device (1).

10. The device (1) as claimed in claim 4, wherein the pressure-recording surface (7) of the at least one pressure sensor (6) is arranged on a frame (10) of the device (1).

11. The device (1) as claimed in claim 4, further comprising a seating (11) in which the pressure-transfer element (9) is arranged.

12. The device (1) as claimed in claim 11, wherein the seating (11 is arranged in at least one of a guided or moveable manner in an operating direction (Pf.1) of the at least one processing tool (3, 4).

13. The device (1) as claimed in claim 4, wherein the device (1), as at least one processing tool, includes at least one of a drill (3) for the manufacture of bundle-accommodating holes (12) in a bristle holder (5), or an insertion tool (4) for filling the bundle-accommodating holes (12) of a bristle holder (5) with bundles of bristles (13).

14. The device (1) as claimed in claim 4, wherein the at least one pressure-recording surface (7) of the pressure sensor (6) is arranged behind the support (8) arranged in the processing position (P) in the operating direction of the at least one processing tool (3, 4).

15. The device (1) as claimed in claim 4, wherein the at least one pressure-recording surface (7) of the pressure sensor (6) is arranged behind the bristle holder (5) arranged on said support (8) in the operating direction of the at least one processing tool (3, 4).

16. The device as claimed in claim 6, wherein the at least one support (8) has a clamping device (16) for the bristle holder (5).

17. The device as claimed in claim 4, further comprising a comparator (17) and a controller (18), which is configured to receive signals from the comparator (17), the comparator (17) is configured to compare a processing pressure or actual pressure determined with the at least one pressure sensor (6) with a stored target pressure, and to output a signal to the controller (18), said signal representing a deviation between the actual pressure and the target pressure, and the controller (18) is configured to shut down the device (1) as a function of the deviation between the target pressure and actual pressure determined by the comparator (17).

* * * * *